US011001080B2

(12) United States Patent
Sanada et al.

(10) Patent No.: US 11,001,080 B2
(45) Date of Patent: May 11, 2021

(54) INK JET RECORDING METHOD OF EJECTING AN AQUEOUS INK HAVING A CERTAIN DYNAMIC SURFACE TENSION

(71) Applicant: CANON KABUSHIKI KAISHA, Tokyo (JP)

(72) Inventors: Mikio Sanada, Kawasaki (JP); Shigemoto Abe, Yokohama (JP); Sayoko Nagashima, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 78 days.

(21) Appl. No.: 16/372,672

(22) Filed: Apr. 2, 2019

(65) Prior Publication Data

US 2019/0308423 A1 Oct. 10, 2019

(30) Foreign Application Priority Data

Apr. 6, 2018 (JP) ..... JP2018-073750
Mar. 25, 2019 (JP) ..... JP2019-056658

(51) Int. Cl.
*B41J 11/00* (2006.01)

(52) U.S. Cl.
CPC ..... *B41J 11/002* (2013.01); *B41J 11/0015* (2013.01)

(58) Field of Classification Search
CPC ..... B41J 11/002; B41J 11/0015; B41M 7/009
See application file for complete search history.

(56) References Cited

U.S. PATENT DOCUMENTS 7,682,433 B2 3/2010 Yanagimachi et al.
7,699,924 B2 4/2010 Mafune et al.
7,846,247 B2 12/2010 Mizutani et al.
7,862,653 B2 1/2011 Sanada et al.
7,919,544 B2 4/2011 Matsuyama et al.
7,988,277 B2 8/2011 Moribe et al.
8,016,932 B2 9/2011 Okamura et al.
8,042,906 B2 10/2011 Chiwata et al.
8,382,230 B2 2/2013 Furukawa
10,160,248 B2 12/2018 Aoai et al.
2016/0288535 A1* 10/2016 Sumikawa ..... B41J 11/0015

FOREIGN PATENT DOCUMENTS

JP 2006-124606 A 5/2006
JP 2008-162097 A 7/2008
JP 2009-096175 A 5/2009
JP 2010-208108 A 9/2010
JP 2011-207004 A 10/2011
JP 2016-064627 A 4/2016

* cited by examiner

*Primary Examiner* — Henok D Legesse
(74) *Attorney, Agent, or Firm* — Venable LLP

(57) ABSTRACT

To provide an ink jet recording method capable of recording a high-quality image excellent in optical density and water resistance and at the same time, suppressing peeling-off of an image caused by contact heating of a recording medium. The ink jet recording method has a step of ejecting an aqueous ink containing a resin particle from a line head and applying the aqueous ink to a predetermined position of a recording medium having ink absorbability and a step of bringing a heating roller into contact with the aqueous ink applied to the recording medium to heat it and fixing it at the predetermined position. The dynamic surface tension of the aqueous ink at the time when the heating roller is brought into contact with the aqueous ink applied to the recording medium is higher than the surface tension of the heating roller.

15 Claims, 2 Drawing Sheets

INK JET RECORDING METHOD OF EJECTING AN AQUEOUS INK HAVING A CERTAIN DYNAMIC SURFACE TENSION

BACKGROUND OF THE INVENTION

Field of the Invention

The present invention relates to an ink jet recording method.

Description of the Related Art

An ink jet recording method can record a high-resolution and high-quality image at high speed. To satisfy the need for a higher recording speed, there is known a technology of heating and drying an ink to rapidly reduce the water content therein. For example, a variety of technologies such as warm air drying, infrared drying, microwave drying, heating roller system drying and induction-heat drying has been developed. Of these, a heating roller system drying adopts, different from warm air drying, a system of heating an ink by bringing a fixing roller into direct contact with an object so that an image can be fixed after drying the ink more rapidly at less power consumption.

For example, there is proposed a recording method having a step of transferring an intermediate image formed on a transfer body to a recording medium such as paper and then carrying out contact heating with a roller (Japanese Patent Application Laid-Open No. 2009-096175). There is also proposed a recording method in which an image recorded by applying an ink to a low ink absorbability recording medium such as coated paper for printing is contact-heated using a roller (Japanese Patent Application Laid-Open No. 2008-162097). There is further proposed a method of contact-heating an image recorded by applying a resin particle-containing ink to a recording medium by using a roller to melt the resin particle (Japanese Patent Application Laid-Open No. 2010-208108).

SUMMARY OF THE INVENTION

In order to record an image at high speed by a method of applying an ink to a recording medium having ink absorbability, an aqueous ink permeable to a recording medium is used to prevent the ink which has remained in liquid form on the surface of the recording medium from transferring to another recording medium. But, using an ink having permeability to suppress transfer thereof may sometimes cause problems such as wrinkling of the recording medium.

In an ink jet recording method, a minute ink droplet should be applied accurately to a desired position of a recording medium so that in a region corresponding to a recording head, the recording medium is retained with accuracy. In an ink jet recording method in which an image is recorded by ejecting an ink from a line-type recording head (line head), a recording medium that passes a region corresponding to the line head is conveyed as soon as being released from the accurately retained state. When an aqueous ink is used, a recording medium containing water is conveyed without application of a sufficient tension so that a curling phenomenon causing deformation of the recording medium is likely to occur. The deformation portion comes into contact with a following recording medium, which may cause a problem such as difficulty in continuous paper delivery. In an ink jet recording method in which an image is recorded by ejecting an ink from a serial-type recording head (serial head), on the other hand, a recording medium is retained with precision during a period from application of an ink to a predetermined region to completion of single main scanning of the recording head. In this method compared with the method using a line head, deformation of a recording medium is suppressed to some extent. In either type, a recording medium, after application of an aqueous ink thereto, gradually expands with the water content therein so that it curls more easily upon paper delivery.

A method of bringing a heating roller into contact with a recorded image and thereby evaporating the water content in the ink is also effective for suppressing curling of the recording medium. When the heating roller is pressed against the recording medium after the medium has expanded to some extent, the expanded portion of the recording medium is pressed by the heating roller and the recording medium is likely to have a wrinkle. When the heating roller is pressed against the recording medium before the medium expands or is deformed, on the other hand, the recording medium does not have a wrinkle easily. When the heating roller is pressed against the recording medium after application of an ink but before deformation, a portion of the ink which has not yet finished permeation into the recording medium and has remained on the surface thereof attaches easily to the heating roller. It has been found that the portion of the ink which has attached to the heating roller causes new problems such as occurrence of peeling-off of an image to reduce an optical density and attachment of the ink, which has attached to the heating roller, to an unintended position such as non-recording part of the recording medium. Further, addition of a resin particle to an ink for obtaining an image having improved optical density and water resistance tends to cause peeling-off of an image more easily.

An object of the invention is therefore to provide an ink jet recording method capable of recording a high-quality image excellent in optical density and water resistance and at the same time, reducing peeling-off caused by contact heating of a recording medium.

The above-described object can be achieved by the invention described below. The invention provides an ink jet recording method including an ink application step, that is, a step of ejecting an aqueous ink containing a resin particle from a line head to apply the aqueous ink to a predetermined position of a recording medium having ink absorbability and a fixing step, that is, a step of bringing a heating roller into contact with the aqueous ink applied to the recording medium to heat the aqueous ink and fixing it to the predetermined position. In this method, the dynamic surface tension $\gamma_I$ (mN/m) of the aqueous ink at the time when the heating roller is brought into contact therewith is higher than the surface tension $\gamma_R$ (mN/m) of the heating roller.

The invention provides an ink jet recording method capable of recording a high-quality image excellent in optical density and water resistance and reducing peeling-off caused by contact heating of a recording medium.

Further features of the present invention will become apparent from the following description of exemplary embodiments with reference to the attached drawings.

DESCRIPTION OF THE EMBODIMENTS

Figure 1:
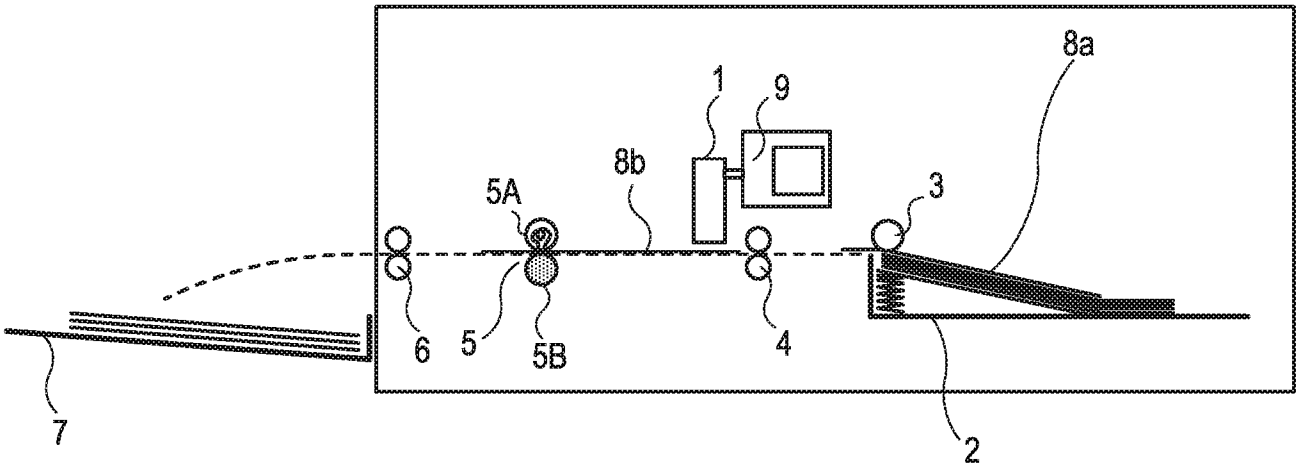
FIG. 1 is a schematic view showing one example of an ink jet recording apparatus.

The invention will hereinafter be described in further detail by preferred embodiments. In the invention, when a compound is a salt, it is dissociated into ions in an ink, but for convenience sake, an expression "contains a salt" is used. An aqueous ink for ink jet may hereinafter be called "ink" simply. A recording medium having ink absorbability may hereinafter be called "recording medium" simply. A physical property value is a value at normal temperature (25° C.) unless otherwise particularly specified.

First, a relation between the surface tension of a heating roller and a dynamic surface tension of the ink during a period of time from application of the ink to a recording medium having ink absorbability to contact of the heating roller to the ink will be described. The dynamic surface tension of a liquid shows either one of the following properties: (1) it decreases with the passage of time and (2) it keeps a certain value. This means that the dynamic surface tension of a liquid never increases with the passage of time in principle. It is therefore necessary to consider, as the dynamic surface tension of the ink during a period of time from application of the ink to a recording medium to contact of the heating roller to the ink, a value at the time when it becomes the lowest; that is, a value at the time when the heating roller is brought into contact with the roller.

It is known that addition of a resin particle to an ink is effective for obtaining an image having improved optical density and water resistance. Since the resin particle controls optical properties by reducing scattering of light incident on an image or enhancing a refractive index of an image portion, addition of it contributes to improvement in optical density. In addition, the resin particle facilitates protection of a coloring material of the image portion so that the resulting image has improved water resistance.

The heating roller is brought into contact with an ink ejected from a line head and applied to a predetermined position of a recording medium to evaporate the water content in the ink before swelling and deformation of the recording medium. This makes it possible to prevent the recording medium from curling which tends to occur during high-speed recording. During a very short time before swelling of the recording medium with water content in the ink starts, however, the recording medium is not wetted sufficiently with the ink. When the heating roller is brought into contact with the ink while the recording medium is not wetted sufficiently with the ink, the ink is sandwiched between the recording medium and the heating roller. When the heating roller starts to separate from the ink under such a state, the ink is pulled from both the recording medium and the heating roller. Further, when the heating roller is wetted with the ink under such a state, a portion of the ink attaches to the heating roller and causes a peeling-off of image. Still further, addition of a resin particle to the ink tends to accelerate peeling-off of image. This occurs because when the resin particle-containing ink is applied to the recording medium, the liquid component is temporarily retained in the space between the resin particles and slightly retards wetting of the recording medium with the ink or permeation of the ink in the recording medium.

As a result of investigation with a view to overcoming the above-described problems which the resin particle-containing ink tends to cause, the present inventors have found that they can be overcome by setting the dynamic surface tension of the ink when heated to be higher than the surface tension of the heating roller. This makes it possible to suppress the heating roller from being wetted with the ink and prevent a portion of an image from attaching to the heating roller.

<Ink Jet Recording Method>

The ink jet recording method of the invention has an ink application step, that is, a step of ejecting a aqueous ink from a line head and applying the ink to a predetermined position of a recording medium having ink absorbability and a fixing step, that is, a step of bringing a heating roller into contact with the ink to heat the ink and fixing it to the predetermined position of the recording medium. This aqueous ink contains a resin particle. The dynamic surface tension $\gamma_I$ (mN/m) of the aqueous ink at the time when the heating roller is brought into contact with the ink applied to the recording medium is higher than the surface tension $\gamma_R$ (mN/m) of the heating roller. The details of the ink jet recording method of the invention will hereinafter be described. The ink jet recording method of the invention needs none of a step of applying a reaction liquid reactive with the ink to the recording medium in advance, an ink curing step and another drying step such as blasting between the ink application step and the fixing step.

(Ink Application Step)

The ink application step ejects an aqueous ink from a line head and applies it to a predetermined position of a recording medium. The line head is a line-type recording head in which ejection orifices (nozzles) for ejecting an ink are arranged over the whole width (maximum paper width) of the recording medium in the conveying direction thereof. Using this line head can achieve an improved recording speed compared with using a serial-type recording head (serial head). The serial-type recording head adopts a system of moving the recording head in repetition in a direction (main-scanning direction) orthogonal to a paper feed direction (sub-scanning direction) and thereby recording an image.

In the ink application step, when the ink is applied to a unit region of the recording medium based on an image data having an ink coverage of 100%, it is preferred to apply an ink droplet to each of unit pixels constituting the unit region. Under the conditions where an ink droplet is applied to each of unit pixels constituting the unit region, the ink is applied to each pixel so as not to allow existence of a blank pixel in the unit region to which the ink is applied because image data therefor are present. The optical density of the image can be enhanced by recording under such conditions. The unit region includes a combination of a plurality of unit pixels determined by a resolution. The term "ink coverage" means so-called "recording duty" and at 100% of the coverage, the unit region of the recording medium is covered with ink dots. An image of a text is often recorded at a coverage of 100% so that enhancement of an optical density at a coverage of 100% is important for recording a high-quality image.

For example, a relationship between a condition of an ink application amount and an optical density is compared under the conditions where the same amount of an ink is applied to a unit region including four unit pixels. Supposing that an ink droplet having a mass of A (ng) per droplet is applied to each of the four unit pixels, the ink application amount to the unit region becomes A (ng)×4 (droplets)=4 A (ng). Supposing that an ink droplet having a mass of 1.33 A (ng) per droplet is applied only to each of three of the four unit pixels, the ink application amount to the unit region becomes 1.33 A (ng)×3 (droplets)=3.99 A (ng)≈4 (ng). As a result of the investigation by the present inventors, the optical density is higher in the former case than in the latter case, though the ink application is almost the same. Similar results are produced in Evaluation 1 and 3 of Examples described later. This means that even if the ink application amount to the unit region is equal, application of an ink droplet to each pixel without allowing existence of a blank pixel can achieve an improved optical density because it facilitates remaining of a coloring material such as a pigment in the vicinity of the surface of the recording medium.

(Fixing Step)

In the fixing step, the ink applied to a predetermined position of the recording medium in the above-described ink application step is heated by bringing a heating roller into contact therewith and is fixed to the predetermined position. By heating the ink, liquid components such as water constituting the aqueous ink evaporate and the ink can be fixed to a predetermined position of the recording medium. In addition, the dynamic surface tension $\gamma_I$ (mN/m) of the ink when the heating roller is brought into contact with the ink (dynamic surface tension of the ink when heated) is required to be higher than the surface tension $\gamma_R$ (mN/m) of the heating roller. Further, the dynamic surface tension of the ink when the heating roller is brought into contact with the ink $\gamma_I$ (mN/m) is preferably higher by 15.0 mN/m or more than the surface tension $\gamma_R$ (mN/m) of the heating roller. By setting the dynamic surface tension of the ink when heated to be higher by 15.0 mN/m or more than the surface tension of the heating roller, transfer of the ink to an unintended position can be suppressed effectively and at the same time, an image having a higher quality and causing less peeling-off can be recorded. A difference ($\gamma_I$-$\gamma_R$) between the dynamic surface tension of the ink and the surface tension of the roller is preferably 50.0 mN/m or less.

A period of time from application of the ink to the recording medium to contact of the heating roller with the ink is set preferably at 1,000 msec or less (1 sec or less), more preferably 300 msec or less (0.3 sec or less). This facilitates the heating roller to be pressed against the ink in a stage before swelling of the recording medium proceeds and makes it possible to more effectively suppress wrinkling of the recording medium. A period of time from application of the ink to the recording medium to contact of the heating roller to the ink is set preferably at 100 msec or more (0.1 sec or more).

The period of time from application of the ink to the recording medium to contact of the heating roller to the ink can be set, for example, by (i) adjusting a conveying speed of the recording medium, (ii) adjusting a conveying distance or (iii) using (i) and (ii) in combination. A too small conveying speed sometimes makes it difficult to improve a throughput. A too large conveying speed, on the other hand, may deteriorate conveying accuracy and at the same time, deteriorate the accuracy of the attached position of an ink droplet ejected from the recording head. In consideration of these points, the conveying speed of the recording medium is set preferably at 4 inches/sec or more to 50 inches/sec or less, more preferably 8 inches/sec or more to 35 inches/sec or less.

When the conveying distance is too short, a distance (arrangement distance) between the recording head (line head) and the heating roller becomes too short. Then, the recording head tends to be heated by heat radiated from the heating roller and due to accelerated evaporation of the ink in the vicinity of the ejection orifice, the ink may have deteriorated ejection stability. A too long conveying distance, on the other hand, may lead to an increase in the size of a recording apparatus itself. In consideration of these points, the conveying distance of the recording medium (distance from recording to fixing) is preferably 1 inch or more to 15 inches or less, more preferably 2 inches or more to 10 inches or less.

Examples of a conveying system of the recording medium include roller conveying system, belt conveying system, suction conveying system and electrostatic conveying system. Of these, a roller conveying system is preferably used for conveying a recording medium from the standpoint of simplifying or downsizing the apparatus.

The heating roller is not limited insofar as it can transfer heat by bringing it into direct contact with the ink to efficiently evaporate the water content in the ink. As the heating roller, that made of, for example, a metal, ceramics, rubber or resin can be used. Examples of a material constituting the surface of the heating roller include fluorine-based resins such as perfluoroalkoxyalkane (PFA) and polytetrafluoroethylene (PTFE), polyimides and silicones. Of these, fluorine-based resins and polyimides are preferred, with fluorine-based resins being more preferred from the standpoint of heat resistance, water repellency and release properties. The material constituting at least the surface of the heating roller is not particularly limited insofar as the surface tension thereof is lower than the dynamic surface tension of the ink at a predetermined time (at the time when the heating roller is brought into contact with the ink). More specifically, it is preferably 15.0 mN/m or more to 60.0 mN/m or less, more preferably 20.0 mN/m or more to 50.0 mN/m or less.

The surface tension of the heating roller can be measured in accordance with the test method specified in JIS K6768: 1999 (Plastics—Film and sheeting—Determination of wetting tension). Examples of a reagent used for determination of wetting tension include commercially available mixed liquids, organic solvents and mixed liquids of an organic solvent. Described specifically, a series of reagents having surface tensions increasing stepwise, respectively, are added dropwise to a sample to be measured and its wet state (whether it is wet or not) is checked. The surface tension of the reagent by which wetting occurs is designated as a surface tension (unit: mN/m) of the sample. The surface tension of the heating roller used herein is a value measured at 25° C.

As a value showing the surface properties of a solid, not a surface tension (mN/m) but "surface free energy (mJ/m$^2$)" is often used. They are equal in numerical value, though different in unit and name. In the invention, in order to compare with the dynamic surface tension (mN/m) of the ink, the relationship with the heating roller which is a solid is analyzed by making use of "surface tension". In general, the surface tension of a substance tends to decrease with an increase in temperature from normal temperature (25° C.). The relationship of surface tension is free from reversal or increase in difference between normal temperature and heated state within an ordinary using range in an ink jet recording method using an aqueous ink. In the invention, the ink is fixed by the heating roller so that the relationship can also be determined by the surface tension at the actual temperature, but the relationship is determined for the convenience sake by the (dynamic) surface tension of the ink and the heating roller at 25° C. because of the above-described reason.

In the fixing step, application of heat enough for evaporating half or more of the water content in the ink applied to the recording medium is preferred, with application of heat enough for evaporating all the water content in the ink being more preferred. More specifically, the heating temperature may be adjusted within a temperature range described later.

The heat applied to the recording medium in the fixing step can be controlled by adjusting both the temperature of the heating roller and the fixing time. The fixing time can be controlled mainly by adjusting the conveying speed. The fixing time can also be controlled by increasing or decreasing the number of heating rollers. The number of the heating rollers provided in one recording apparatus is preferably 1 or more to 4 or less from the standpoint of downsizing the apparatus and designing ease thereof, with 1 or more to 2 or less being more preferred. When a plurality of heating rollers is installed, a heating roller for specifying the surface tension to be compared with the dynamic surface tension of the ink is a heating roller on the uppermost stream side (a heating roller to be brought into contact with the ink first) in the conveying direction of the recording medium.

When the temperature of the heating roller is too low, the conveying speed of a recording medium should be decreased to apply sufficient heat to the ink. This sometimes makes it difficult to improve throughput. When the temperature of the heating roller is too high, on the other hand, an electric quantity necessary for driving a recording apparatus is likely to increase. Further, since an image is recorded with a resin particle-containing ink in the invention, when the temperature of the heating roller is too high, hot offset such as so-called "undesirable parting" tends to occur. In consideration of the above-described points, the temperature of the heating roller is preferably 100° C. or more to 250° C. or less. The effective temperature upon fixing can be understood indirectly by conveying a recording medium without applying an ink thereto and measuring the surface temperature of the recording medium by an infrared thermometer or the like rightly after the recording medium passes the heating roller.

(Ink Jet Recording Apparatus)

The ink jet recording method of the invention can be carried out using an ink jet recording apparatus equipped with a line head that ejects an ink by an ink jet method. FIG. 1 is a schematic view showing one example of an ink jet recording apparatus. The ink jet recording apparatus shown in FIG. 1 has a line-type recording head (line head) 1 equipped with an ejection orifice that ejects an ink, a paper feed cassette 2, a paper feed roller 3 and a conveying roller 4. The ink jet recording apparatus shown in FIG. 1 further has a contact type heating roller 5 which is a heating means for drying an ink on a recording medium 8*b*, a paper delivery roller 6 and a paper delivery tray 7. A control unit 9 controls the rotation direction or speed of each roller and the temperature of a heater of the contact type heating roller 5. Further, the control unit 9 is connected to the recording head 1 so as to control the movement of the recording head 1 depending on the conveyance of the recording medium 8*a*.

An image is recorded in the following order. First, the recording medium 8*a* picked up by the paper feed roller 3 from the paper feed cassette 2 is conveyed by the conveying roller 4. An ink ejected from the recording head 1 is applied to a predetermined position of the recording medium 8*a*. After the recording medium 8*b* having the ink applied to the predetermined position thereof passes the contact type heating roller 5 while gradually evaporating the water content in the ink on the recording medium 8*b*, it is conveyed by the paper delivery roller 6 and then, placed on the paper delivery tray 7.

Figure 2:
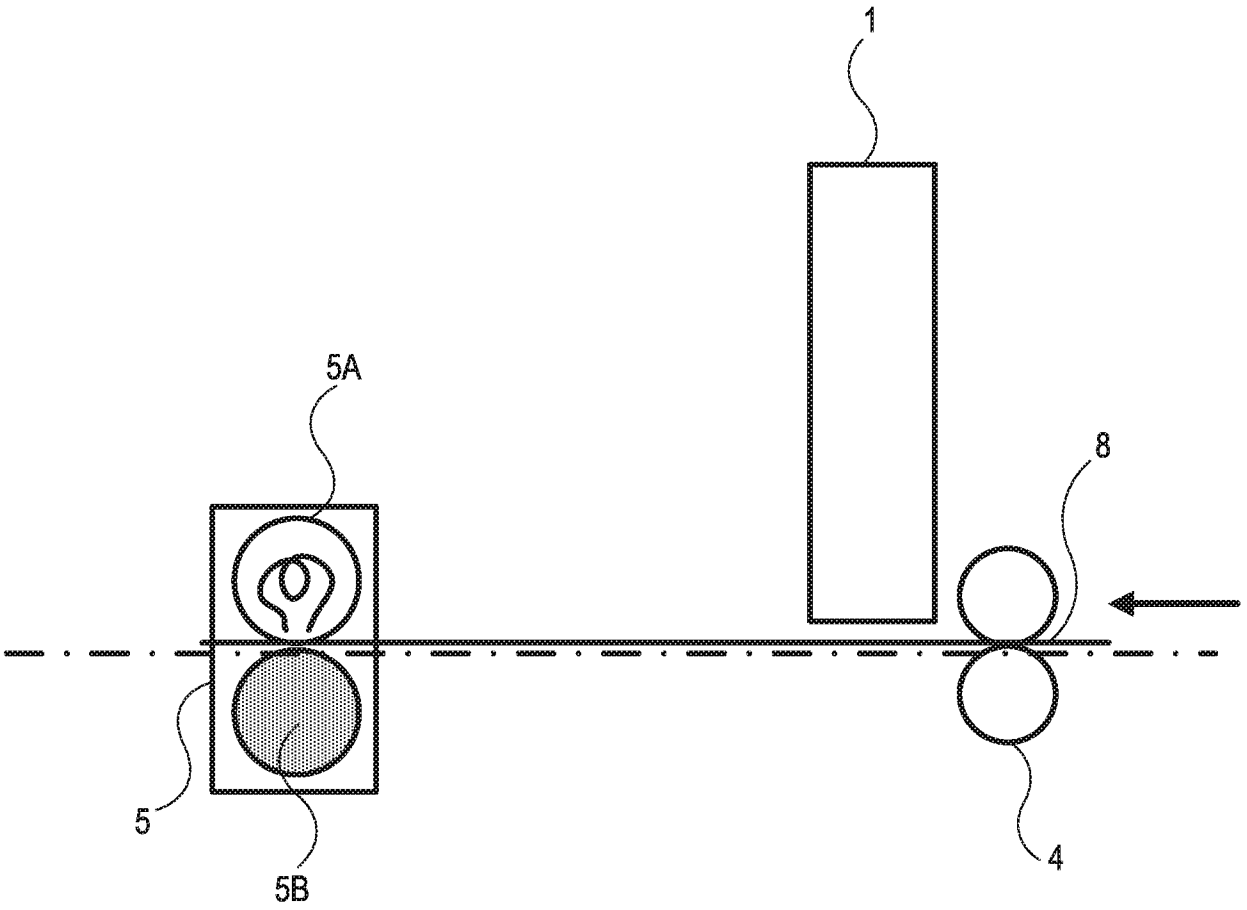
FIG. 2 is an enlarged schematic view showing a portion of the ink jet recording apparatus shown in FIG. 1.

FIG. 2 is an enlarged schematic view of a portion of the ink jet recording apparatus shown in FIG. 1. As shown in FIG. 2, the contact type heating roller 5 includes a pair of upper and bottom rollers 5A and 5B. The roller 5A placed on the upper side is, for example, a heating roller having a heater such as halogen heater housed therein. The roller 5B placed on the bottom side is, for example, a pinch roller 5B constituted to sandwich and convey the recording medium 8 between it and the roller 5A. The contact type heating roller 5 can heat the recording medium 8 and the ink applied to the predetermined position on the recording medium 8, when they pass the contact type heating roller 5, to evaporate the water content in the ink and fix the ink to the predetermined position of the recording medium 8.

As the recording medium 8, that having ink absorbability is used. Described specifically, the term "recording medium" in the recording method of the invention does not include a recording medium, such as transfer body, having no ink absorbability. In other words, the ink jet recording method of the invention adopts so-called "direct recording system". Specific examples of the recording medium 8 include a recording medium, such as plain paper, not having a coated layer and a recording medium, such as coated paper for printing and glossy paper, having a coated layer Of these, a recording medium not having a coated layer is preferred, with plain paper being more preferred.

<Ink>

An ink is an ink jet aqueous ink designed to have a dynamic surface tension $\gamma_I$ (mN/m) at the time when a heating roller is brought into contact therewith higher than the surface tension $\gamma_R$ (mN/m) of the heating roller. Components constituting the ink and physical properties thereof other than the dynamic surface tension are not particularly limited.

The dynamic surface tension of the ink can be adjusted by setting the kind or content of a water-soluble organic solvent or surfactant as needed. The dynamic surface tension of the ink is measured by a maximum bubble pressure method. Maximum bubble pressure method is a method of measuring the maximum pressure necessary for releasing bubbles formed at the tip portion of a probe (capillary) immersed in a liquid to be measured and determining the surface tension of the liquid based on the maximum pressure thus measured. The lifetime in the maximum bubble pressure method is, when a bubble is formed at the tip portion of the probe, from the time when the bubble is detached from the tip portion and a new bubble surface is formed to the maximum foam pressure (time when the radius of curvature of the bubble becomes equal to the radius of the tip portion of the probe). The dynamic surface tension of the ink used herein is a value measured at 25° C.

The dynamic surface tension of the ink at a predetermined time (time when the heating roller is brought into contact with the ink) is not particularly limited insofar as it is higher than the surface tension of the heating roller. More specifically, the dynamic surface tension of the ink at a predetermined time (for example, 200 msec, 1000 msec) is preferably 25.0 mN/m or more to 65.0 mN/m or less, more preferably 30.0 mN/m or more to 55.0 mN/m or less.

(Coloring Material)

The ink may contain a dye or pigment as a coloring material. The content (% by mass) of the coloring material in the ink is preferably 0.50% by mass or more to 15.00% by mass or less, more preferably 1.00% by mass or more to 10.00% by mass or less, each based on the total mass of the ink.

Examples of the dye include those having an anionic group. Specific examples include compounds having a skeleton such as phthalocyanine, azo, xanthene or anthrapyridone.

Examples of the pigment include inorganic pigments such as carbon black and titanium oxide and organic pigments such as azo, phthalocyanine, quinacridone, isoindolinone, imidazolone, diketopyrrolopyrrole and dioxazine. As the pigment, a resin dispersed type pigment using a resin as a dispersant and a self-dispersible type pigment (self-dispersible pigment) having a hydrophilic group introduced into the surface of the pigment particle can be used.

Examples of the resin-dispersed type pigment include resin-dispersed pigments using a resin dispersant, microencapsulated type pigments obtained by covering the surface of the pigment particle with a resin and a resin bonded type pigment obtained by chemically bonding a polymer-containing organic group to the surface of the pigment particle. As the resin dispersant, resins described later can be used. Of these, preferred are acrylic resins having a hydrophilic unit derived from an anionic-containing monomer such as (meth) acrylic acid and a hydrophobic unit derived from a monomer having an aromatic ring or aliphatic group but not having an anionic group.

As the self-dispersible pigment, usable are those having an anionic group bonded to the surface of the pigment particle directly or via another atomic group. Examples of the anionic group include a carboxylic acid group, a sulfonic acid group, a phosphoric acid group and a phosphonic acid group. Examples of a counter ion of the anionic group include a hydrogen atom and cations such as alkali metal, ammonium and organic ammonium. The another atomic group is preferably a group having a function of a spacer between the surface of the pigment particle and the ionic group and it has preferably a molecular weight of 1,000 or less. Examples of the another atomic group include alkylene groups having about 1 to 6 carbon atoms, arylene groups such as phenylene and naphthylene, ester groups, imino groups, amide groups, sulfonyl groups and ether groups. A group using these groups in combination can also be used.

Of the above-described coloring materials, the pigments are preferred because they enable recording of an image excellent in optical density. Of the pigments, the self-dispersible pigment is preferred. The resin-dispersed pigment sometimes easily causes peeling-off of image because a resin dispersant for dispersing the pigment easily attaches to the heating roller. On the other hand, the self-dispersible pigment can be used particularly preferably because it does not essentially need a resin dispersant for dispersing the pigment so that it hardly attaches to the heating roller and hardly causes peeling-off of image.

(Resin Particle)

The ink contains a resin particle. Examples of a resin-particle forming resin include acrylic resins, urethane resins and olefin resins. Of these, acrylic resins and urethane resins are preferred, with the acrylic resins being particularly preferred. The resin particle does not necessarily include therein a coloring material. The content (% by mass) of the resin particle in the ink is preferably 0.10% by mass or more to 20.00% by mass or less, more preferably 0.50% by mass or more to 15.00% by mass or less, each based on the total mass of the ink. Further, a mass ratio of the content (% by mass) of the resin particle to the content of the coloring material (% by mass) in the ink is preferably 0.50 or more to 5.00 or less, more preferably 0.50 or more to 2.00 or less.

As the acrylic resins, those having a hydrophilic unit and a hydrophobic unit are preferred. Of these, resins having a hydrophilic unit derived from (meth)acrylic acid and a hydrophobic unit derived from at least one of an aromatic ring-containing monomer and a (meth)acrylate-based monomer are preferred. Particularly preferred are resins having a hydrophilic unit derived from (meth)acrylic acid and a hydrophobic unit derived from a (meth)acrylate-based monomer.

The hydrophilic unit is a unit having a hydrophilic group such as anionic group. The hydrophilic unit can be formed, for example, by polymerizing a hydrophilic monomer having a hydrophilic group. Specific examples of the hydrophilic monomer having a hydrophilic group include acidic monomers having a carboxylic acid group such as (meth) acrylic acid, itaconic acid, maleic acid or fumaric acid and anionic monomers such as anhydrides or salts of these acidic monomers. Examples of a cation constituting the salt of the acidic monomer include ions such as lithium, sodium, potassium, ammonium, and organic ammonium. The hydrophobic unit is a unit not having a hydrophilic group such as anionic group. The hydrophobic unit can be obtained by polymerizing a hydrophobic monomer not having a hydrophilic group such as anionic group. Specific examples of the hydrophobic monomer include aromatic ring-containing monomers such as styrene, α-methylstyrene and benzyl (meth)acrylate and (meth)acrylate-based monomers such as methyl (meth)acrylate, n-butyl (meth)acrylate and 2-ethylhexyl (meth)acrylate.

As the urethane-based resin, for example, that obtained by reacting a polyisocyanate with a polyol can be used. It may be obtained by reacting, in addition to them, with a chain extender. Examples of the olefin-based resin include polyethylene and polypropylene.

The acid value of the resin particle is preferably 5 mgKOH/g or more to 100 mgKOH/g or less. The weight-average molecular weight of the resin particle is preferably 1,000 or more to 2,000,000 or less. The weight-average molecular weight is a value in terms of polystyrene measured using gel permeation chromatography. The volume-based cumulative particle size at 50% of the resin particle measured by dynamic light scattering method (under measurement conditions similar to those described later) is preferably 50 nm or more to 500 nm or less.

The minimum film forming temperature of the resin particle is preferably 0° C. or more to 200° C. or less. Particularly, the temperature is preferably 60° C. or less, more preferably 50° C. or less. The term "minimum film forming temperature of the resin particle" as used herein means the minimum temperature necessary for melting the resin particle by heating to form a resin film. In the invention, the minimum film temperature of the resin particle is treated as a property of the resin particle itself. This means that used is not a measured value of, for example, an ink containing therein both a resin particle and a component such as a water-soluble organic solvent or an additive of the ink but a measured value of an aqueous dispersion liquid (a liquid containing neither a water-soluble organic solvent nor additive of an ink). For analysis using the ink, an aqueous dispersion liquid obtained by dispersing a resin particle separated from the ink in water may be used. The minimum film forming temperature can be measured in accordance with a test method described in JIS K6828-2:2003 (Plastics—Polymer Dispersions Second Section—Determination of white point temperature and minimum film forming temperature). The minimum film forming temperature of the resin particle can be adjusted, for example, by changing conditions such as kind or amount of a monomer used for synthesis of a resin.

The term "resin particle" means a resin that does not dissolve in an aqueous medium constituting an ink, more specifically, a resin that can be present in an aqueous medium while forming a particle whose particle size can be measured by a dynamic light scattering method when neutralized with an amount of an alkali equivalent to the acid value. On the other hand, the term "water-soluble resin" means a resin soluble in an aqueous medium constituting an ink, more specifically, a resin that can be present in an aqueous medium without forming a particle whose particle size can be measured by a dynamic light scattering method, when neutralized with an amount of an alkali equivalent to the acid value.

Whether the resin is a "resin particle" or not can be judged according to the following method. First a liquid (resin content: 10% by mass) containing a resin neutralized with an alkali (sodium hydroxide, potassium hydroxide or the like) equivalent to the acid value is prepared. Then, the liquid thus prepared is diluted to 10 times (based on volume) with pure water to prepare a sample. When a particle having a particle size is measured as a result of measurement of the particle size of the resin in the sample by a dynamic light scattering method, the particle is judged as "water dispersible". On the other hand, when a particle having a particle size is not measured, the resin is judged that it is not a "resin particle" (meaning that it is a water-soluble resin). The above-described measurement can be performed, for example, under the following conditions: SetZero: 30 seconds, measurement times: 3, measurement time: 180 seconds, shape: spherical and refractive index: 1.59. As a particle size distribution measuring apparatus, a particle size analyzer (for example, "Nanotrac UPA-EX150", trade name; product of Microtrac-BEL) adopting a dynamic light scattering method or the like can be used. It is needless to say that the particle size distribution measuring apparatus, measurement conditions and the like are not limited to those described above.

(Another Resin)

The ink may contain, in addition to the resin particle, another resin (water-soluble resin). The water-soluble resin may be a resin dispersant for dispersing the pigment. As the form of the water-soluble resin, a block copolymer, a random copolymer and a graft copolymer and a combination of any of them may be used. Examples of the water-soluble resin include acrylic resins, urethane resins and olefin resins. Of these, acrylic resins and urethane resins are preferred. Since the water-soluble resin tends to attach to the heating roller, it is preferred not to increase its content excessively. The content (% by mass) of the another resin (water-soluble resin) in the ink is preferably 0.10% by mass or more to 10.00% by mass or less, more preferably 0.10% by mass or more to 5.00% by mass or less, each based on the total mass of the ink.

The acid value of the water-soluble resin is preferably 100 mgKOH/g or more to 250 mgKOH/g or less. The water-soluble resin has preferably a weight-average molecular weight of 3,000 or more to 15,000 or less. The weight-average molecular weight is a value in terms of polystyrene measured by gel permeation chromatography.

(Aqueous Medium)

The ink to be used in the ink jet recording method of the invention is an ink jet aqueous ink containing an aqueous medium containing water. The water is preferably deionized water (ion exchanged water). The content (% by mass) of the water in the ink is preferably 10.00% by mass or more to 90.00% by mass or less, more preferably 30.00% by mass or more to 70.00% by mass or less, each based on the total mass of the ink. In order to effectively suppress deformation (curling) of the recording medium at the time of paper delivery, it is preferred that a water content in the ink has sufficiently evaporated at the time of paper delivery. The water content in the ink as small as possible is therefore preferred, though the balance with the reliability such as ejection stability or less clogging of the ink should be considered in advance.

The aqueous medium may contain a water-soluble organic solvent further. The water-soluble organic solvent is not particularly limited insofar as it is soluble in water. Examples of the usable aqueous medium include monohydric alcohols, polyhydric alcohols, (poly)alkylene glycols, glycol ethers, nitrogen-containing polar solvents and sulfur-containing polar solvents. The content (% by mass) of the water-soluble organic solvent in the ink is preferably 3.00% by mass or more to 50.00% by mass or less based on the total mass of the ink.

(Another Additive)

The ink may contain, in addition to the above-described components, a water-soluble organic compound which is solid at normal temperature, if necessary. Examples of it include polyhydric alcohols such as trimethylolpropane and trimethylolethane and urea derivatives such as urea and ethylene urea. The ink may further contain, if necessary, various additives such as surfactant, pH regulator, rust inhibitive, antiseptic, mildew proofing agent, antioxidant, reduction preventive, evaporation accelerator and chelating agent.

(Physical Properties of Ink)

The ink has a viscosity at 25° C. of preferably 1.0 mPa·s or more to 15.0 mPa·s or less, more preferably 1.0 mPa·s or more to 10.0 mPa·s or less. The ink has pH at 25° C. of preferably 5 or more to 9 or less.

EXAMPLES

The invention will hereinafter be described in further detail by Examples and Comparative Examples. The invention is however not limited by the following examples insofar as it does not exceed the gist of thereof. With respect to the amount of the components, all designations of "part" or "parts" and "%" are each on a mass basis unless otherwise particularly specified.

<Preparation of Pigment Dispersion Liquid>

(Pigment Dispersion Liquid 1)

A solution obtained by dissolving 5.0 g of concentrated hydrochloric acid in 5.5 g of water was cooled to 5° C. and 1.5 g of 4-aminophthalic acid was added without changing the temperature. A vessel having the resulting solution therein was placed in an ice bath and while keeping the temperature of the solution at 10° C. or less by stirring, a solution obtained by dissolving 1.8 g of sodium nitrite in 9.0 g of ion exchanged water of 5° C. was added. After stirring for 15 minutes, 6.0 g of carbon black (specific surface area: 220 $m^2/g$, DBP oil absorption amount: 105 mL/100 g) was added under stirring. Stirring was performed for further 15 minutes to obtain a slurry. The resulting slurry was filtered through a filter paper ("Standard filter paper No. 2", trade name; product of Advantec). The particles were washed with water sufficiently and dried in an oven of 110° C. to obtain a self-dispersible pigment having a $—C_6H_3—(COONa)_2$ group bonded to the surface of the carbon black particle. An adequate amount of ion exchanged water was added to adjust the content of the pigment to obtain a pigment dispersion liquid 1 having a pigment content of 15.0%.

(Pigment Dispersion Liquid 2)

A styrene-acrylic acid copolymer (water-soluble resin) having an acid value of 120 mgKOH/g and a weight average molecular weight of 8,000 was neutralized with an aqueous sodium hydroxide solution equimolar to the acid value of the copolymer. The resulting resin (8.0 parts) was mixed with 20.0 parts of carbon black having a specific surface area of 220 $m^2/g$ and a DBP oil absorption amount of 105 mL/100 g and 72.0 parts of ion exchanged water to obtain a mixture. After the resulting mixture was dispersed for 3 hours in a batch type vertical sand mill, the dispersion was centrifuged to remove a coarse particle therefrom. Further, the residue was pressure filtered through a micro filter (product of FUJIFILM) having a pore size of 3.0 μm to obtain a pigment dispersion liquid 2 having carbon black dispersed in water by the resin. The resulting pigment dispersion liquid 2 had a pigment content of 15.0% and a resin content of 6.4%.

<Preparation of Aqueous Dispersion Liquid of Resin Particle>

An emulsified product was prepared by mixing monomers (unit: parts) listed in Table 1 and 3.0 parts of water. After addition of 50.0 parts of water to a four-necked flask equipped with a stirrer, a reflux condenser and a nitrogen gas inlet, a nitrogen gas was introduced into the reaction system and the temperature was raised to 80° C. under stirring. Then, the emulsified product obtained above and 10.0 parts of a 5% aqueous potassium persulfate solution were added dropwise to the flask for 3 hours. Then, aging was performed for 2 hours and an adequate amount of ion exchanged water was added to obtain a resin particle-containing dispersion liquid. An adequate amount of ion exchanged water was then added to adjust the concentration of the dispersion liquid to obtain respective aqueous dispersion liquids of the resin particles 1 to 3, each having a resin particle content of 40.0%.

The volume-based cumulative particle size at 50% of the resin particles 1 to 3 was measured by a dynamic light scattering method. More specifically, the cumulative particle size at 50% was measured using a particle size distribution analyzer ("Nanotrac UPA-EX150", trade name; product of MicrotracBEL) adopting a dynamic light scattering method. The measurement was performed under the following conditions: SetZero: 30 seconds, measurement times: 3, measurement time: 180 seconds, shape: spherical and refractive index: 1.59. The minimum film forming temperature was measured in accordance with JIS K6828-2:2003. More specifically, the minimum film forming temperature was determined as follows. First, the aqueous dispersion liquid obtained above was applied to a test plate of a simple film forming temperature measuring apparatus (product of Imoto Seisakusho) by a blade code (applicator of 0.3 mm). The resulting plate was allowed to stand for 30 minutes and dried. The test plate thus obtained was used as a sample and the temperature at which a scratch appeared by tracing the applied surface with a glass rod while increasing the temperature was designated as a minimum film forming temperature.

TABLE 1

Synthesis condition and property of resin particle

| Resin particle | Monomer (unit: parts) n-Butyl acrylate | Methyl methacrylate | Methacrylic acid | Cumulative volume-average particle size at 50% (nm) | Minimum film forming temperature (° C.) |
|---|---|---|---|---|---|
| 1 | 32.0 | 65.0 | 3.0 | 150 | 35 |
| 2 | 35.0 | 62.0 | 3.0 | 150 | 60 |
| 3 | 50.0 | 47.0 | 3.0 | 150 | 65 |

<Preparation of Ink>

After the components (unit: %) listed in the upper column of Table 2 were mixed and sufficiently stirred, the resulting mixture was pressure-filtered through a micro filter (product of FUJIFILM) having a pore size of 3.0 μm to prepare respective inks. In Table 2, "Acetylenol E100" and "Acetylenol E60" are trade names of nonionic surfactants (product of Kawaken Fine Chemicals), respectively. "Emulmin L90S" is a trade name of a nonionic surfactant (product of Sanyo Chemical). The respective dynamic surface tensions of the inks at lifetimes of 200 msec and 1000 msec are listed in the bottom column of Table 1. The dynamic surface tension γ was measured at 25° C. by using a dynamic surface tensiometer ("Bubble Pressure Tensiometer BP-2", trade name; product of KRUSS) adopting a maximum bubble pressure method.

TABLE 2

Compositions and properties of inks

| | Ink 1 | 2 | 3 | 4 | 5 | 6 | 7 | 8 | 9 | 10 | 11 |
|---|---|---|---|---|---|---|---|---|---|---|---|
| C.I. Acid Red 289 | | | | | | | | 3.00 | 3.00 | | 3.00 |
| Pigment dispersion liquid 1 | 50.00 | 50.00 | 50.00 | 50.00 | 50.00 | | | | | 50.00 | |
| Pigment dispersion liquid 2 | | | | | | 50.00 | 50.00 | | | | |
| Aqueous dispersion liquid of resin particle 1 | 10.00 | 10.00 | 10.00 | | | 10.00 | 10.00 | 15.00 | | | |

TABLE 2-continued

| Compositions and properties of inks | | | | | | | | | | | |
|---|---|---|---|---|---|---|---|---|---|---|---|
| | Ink | | | | | | | | | | |
| | 1 | 2 | 3 | 4 | 5 | 6 | 7 | 8 | 9 | 10 | 11 |
| Aqueous dispersion liquid of resin particle 2 | | | | 10.00 | | | | | | | |
| Aqueous dispersion liquid of resin particle 3 | | | | | 10.00 | | | | 15.00 | | |
| Glycerin | 10.00 | 10.00 | 10.00 | 10.00 | 10.00 | 10.00 | 10.00 | 10.00 | 10.00 | 10.00 | 10.00 |
| Trimethylolpropane | 10.00 | | | | | 10.00 | 10.00 | 10.00 | 10.00 | | 10.00 |
| Polyethylene glycol (number average molecular weight: 600) | | 10.00 | 10.00 | 10.00 | 10.00 | | | | | 10.00 | |
| 1,2-Hexanediol | | 2.00 | | | | 3.00 | 3.00 | | | | |
| Acetylenol E100 | | | | | | | | 0.40 | 0.40 | 0.070 | 0.40 |
| Acetylenol E60 | | | | | | 0.12 | 0.40 | | | | |
| Emulmin L90S | | | 0.40 | 0.40 | 0.40 | | | | | | |
| Ion exchanged water | 20.00 | 18.00 | 19.60 | 19.60 | 19.60 | 16.88 | 16.60 | 61.60 | 61.60 | 29.93 | 76.60 |
| Dynamic surface tension at 200 msec (mN/m) | 53.6 | 43.5 | 39.3 | 39.3 | 39.3 | 37.3 | 34.9 | 39.0 | 39.0 | 45.7 | 36.3 |
| Dynamic surface tension at 1,000 msec (mN/m) | 53.0 | 43.2 | 34.5 | 34.5 | 34.5 | 36.1 | 34.0 | 37.0 | 37.0 | 44.0 | 35.1 |

<Evaluation>

An ink jet recording apparatus having a line head loaded therein and having the constitution as shown in FIG. 1 was provided. An ink cartridge filled with each of the inks was set in the ink jet recording apparatus. In the present examples, resolution was set at 1200 dpi (length)×1200 dpi (width) and a unit region was set at 1/600 inch×1/600 inch. One unit region is divided into 4 unit pixels and therefore, one unit pixel has a size of 1/1200 inch×1/1200 inch. The surface temperature of the heating roller was set at 180° C. A recording medium was conveyed at a rate of 16 inches/sec by a roller conveying system. A contact width (nip width) between the heating roller and the recording medium was set at 10 mm and a contact time was adjusted to 0.025 sec. The period of time from application of the ink to a predetermined position of the recording medium to contact of the contact type heating roller to the ink present on the surface of the recording medium was adjusted by a distance (arrangement distance) between the line head and the heating roller.

The surface tension of the heating roller was measured in accordance with JIS K6768:1999 by using a reagent selected from the following ones depending on the surface tension of an object to be measured.

Wetting tension test mixture ("Wetting tension test mixture", trade name; product of FUJIFILM Wako Pure Chemical).

n-Hexane (surface tension: 18.4 mN/m).

Ethanol (surface tension: 22.6 mN/m).

A mixture obtained by mixing n-hexane and ethanol at a predetermined ratio and having a known surface tension.

The following respective evaluations were performed using the above-described ink jet recording apparatus. In the invention, in the evaluation criteria of the respective evaluation items shown below, "A" and "B" mean an acceptable level and "C" means an unacceptable level.

(Evaluation 1)

Various conditions in Evaluation 1 were set as described below. As a heating roller, that having a surface made of a fluorine-based resin (tetrafluoroethylene-perfluoroalkyl vinyl ether copolymer, surface tension: 18.4 mN/m) was used. The heating roller was adjusted so as to come into contact with the ink present on the surface of the recording medium 200 msec after application of the ink to a predetermined position of the recording medium. The ink application conditions for recording an image having a recording duty of 100% were as follows. Described specifically, an ink droplet having a mass of 2.50 ng per droplet was added to each of four unit pixels obtained by dividing a 1/600 inch×1/600 inch unit region. A total ink application amount per unit region was therefore 10.0 ng.

[Peeling-Off of Image]

A solid image having a recording duty of 100% was recorded by applying the ink to a longitudinal upper half portion of an A4 recording medium by using all the ejection orifices of the line head used for recording an image. As the recording medium, two kinds of recording media (plain paper, "PB Paper", trade name and "Recycled Classic", trade name; each product of Canon) were used. Peeling-off of image was evaluated based on the following evaluation criteria after observing the solid image thus recorded and the ink transfer state to a non-recorded portion visually and with a 10× magnifier. Evaluation results are shown in Table 3.

A: The two recording media caused neither peeling-off of image nor transfer of the ink to the non-recorded portion of the recording medium.

B: Peeling-off of image was not observed, but in both of the two recording media, there occurred transfer of the ink to the non-recorded portion of the recording medium which was not recognized visually but recognized by observation through the magnifier.

C: In both of the two recording media, peeling-off of image occurred and in addition, visually recognizable transfer of the ink to the non-recorded portion of the recording medium occurred.

[Optical Density]

A solid image having a recording duty of 100% which was similar to that used in the above-described evaluation of "peeling-off of image" was recorded on two kinds of recording media (plain paper, "PB Paper" and "Recycled Classic", each trade name; product of Canon). The optical density of the solid image thus recorded was measured using a fluorescent spectrodensitometer ("FD-7", trade name; product of Konica Minolta) and the optical density was evaluated based on the following evaluation criteria. Evaluation results are shown in Table 3.

A: The optical density was 1.3 or more on both of the two recording media.

B: The optical density in one of the recording media was 1.3 or more, but the optical density on the other recording medium was less than 1.3.

C: The optical density on each of the two recording media was less than 1.3.

[Water Resistance]

By using a 10-point MS Mincho font, characters were recorded on a recording medium (plain paper, "PB Paper", trade name; product of Canon) under the conditions of a recording duty of 100% and the recorded matter was dried by placing it for one hour in an environment of 25° C. and relative humidity of 50%. In the case where recording was performed using an ink having a pigment as a coloring material, smear of the ink transferred to a non-recorded portion was visually checked by marking a text part with a yellow fluorescent pen "Fluorescent OPTEX 1EZ", trade name; product of Zebra). In the case where recording was performed using an ink having a dye as a coloring material, blurring of the ink after 1 mL of tap water was added dropwise to the text part by a syringe while inclining the recorded matter at 45 degrees was visually checked. From the results thus obtained, the water resistance was evaluated based on the evaluation criteria shown below. Evaluation results are shown in Table 3.

A: Neither smear nor blur of the ink occurred on the non-recorded portion.

B: Smear or blur of the ink occurred on the non-recorded portion, though they were not so severe as to give the text lighter.

C: Smear or blur of the ink was observed on the non-recording portion and they give the text lighter.

TABLE 3

Conditions and results of Evaluation 1

| | | Evaluation conditions | | | | Evaluation results | | |
|---|---|---|---|---|---|---|---|---|
| | | Ink | Dynamic surface tension of ink when heated $\gamma_I$ (mN/m) | Surface tension of roller $\gamma_R$ (mN/m) | $\gamma_I - \gamma_R$ (mN/m) | Peeling-off of image | Optical density | Water resistance |
| Example | 1 | 1 | 53.6 | 18.4 | 35.2 | A | A | A |
| | 2 | 2 | 43.5 | 18.4 | 25.1 | A | A | A |
| | 3 | 3 | 39.3 | 18.4 | 20.9 | A | A | A |
| | 4 | 4 | 39.3 | 18.4 | 20.9 | A | A | A |
| | 5 | 5 | 39.3 | 18.4 | 20.9 | A | A | B |
| | 6 | 6 | 37.3 | 18.4 | 18.9 | B | B | A |
| | 7 | 7 | 34.9 | 18.4 | 16.5 | B | B | A |
| | 8 | 8 | 39.0 | 18.4 | 20.6 | A | B | A |
| | 9 | 9 | 39.0 | 18.4 | 20.6 | A | B | B |
| Comp. Ex. | 1 | 10 | 45.7 | 18.4 | 27.3 | A | B | C |
| | 2 | 11 | 36.3 | 18.4 | 17.9 | A | C | C |

(Evaluation 2)

Various conditions in Evaluation 2 were set as described below. As a heating roller, that having a surface made of a polyimide (surface tension: 44.0 mN/m) film was used. The heating roller was adjusted to come into contact with the ink present on the surface of the recording medium 1000 msec after application of the ink to a predetermined position of the recording medium. Conditions except the above-described ones were made similar to those set in "Evaluation 1".

[Peeling-Off of Image]

The peeling-off of image was evaluated based on the procedure and evaluation criteria similar to those in "peeling-off of image" described in "Evaluation 1" except that the kind of the heating roller and the period of time from ink application to heating were changed as described above. Evaluation results are shown in Table 4.

TABLE 4

Conditions and results of Evaluation 2

| | | Evaluation conditions | | | | Evaluation results |
|---|---|---|---|---|---|---|
| | | Ink | Dynamic surface tension of ink when heated $\gamma_I$ (mN/m) | Surface tension of roller $\gamma_R$ (mN/m) | $\gamma_I - \gamma_R$ (mN/m) | Peeling-off of image |
| Example | 10 | 1 | 53.0 | 44.0 | 9.0 | B |
| Comp. Ex. | 3 | 2 | 43.2 | 44.0 | −0.8 | C |
| | 4 | 3 | 34.5 | 44.0 | −9.5 | C |
| | 5 | 4 | 34.5 | 44.0 | −9.5 | C |

TABLE 4-continued

| Conditions and results of Evaluation 2 | | | | | |
|---|---|---|---|---|---|
| | | Evaluation conditions | | | |
| | Ink | Dynamic surface tension of ink when heated $\gamma_I$ (mN/m) | Surface tension of roller $\gamma_R$ (mN/m) | $\gamma_I - \gamma_R$ (mN/m) | Evaluation results Peeling-off of image |
| 6 | 5 | 34.5 | 44.0 | −9.5 | C |
| 7 | 6 | 36.1 | 44.0 | −7.9 | C |
| 8 | 7 | 34.0 | 44.0 | −10.0 | C |
| 9 | 8 | 37.0 | 44.0 | −7.0 | C |
| 10 | 9 | 37.0 | 44.0 | −7.0 | C |
| 11 | 10 | 44.0 | 44.0 | 0.0 | B |
| 12 | 11 | 35.1 | 44.0 | −8.9 | C |

(Evaluation 3)

Various conditions in Evaluation 3 were set as described below. The ink was applied under the conditions where an ink droplet having a mass of 3.33 ng per droplet was applied only to three of four unit pixels obtained by dividing a 1/600 inch×1/600 inch unit region into four. A total ink application amount per unit region is therefore 9.99 ng, that is, about 10.0 ng. This ink application amount is equal to that in the case "where a recording duty is 100%" in "Evaluation 1". Conditions except them were similar to those described above in "Evaluation 1".

[Peeling-Off of Image]

Peeling-off of image was evaluated based on a procedure and evaluation criteria similar to those described in "peeling-off of image" in "Evaluation 1" except that the ink application conditions were changed as described above. Evaluation results are shown in Table 5.

[Optical Density]

Optical density was evaluated based on a procedure and evaluation criteria similar to those described in "optical density" in "Evaluation 1" except that the ink application conditions were changed as described above. Evaluation results are shown in Table 5.

TABLE 5

| Conditions and results of Evaluation 3 | | | | | | | |
|---|---|---|---|---|---|---|---|
| | | | Evaluation conditions | | | Evaluation results | |
| | | Ink | Dynamic surface tension of ink when heated $\gamma_I$ (mN/m) | Surface tension of roller $\gamma_R$ (mN/m) | $\gamma_I - \gamma_R$ (mN/m) | Peeling-off of image | Optical density |
| Example | 11 | 1 | 53.6 | 18.4 | 35.2 | A | B |
| | 12 | 2 | 43.5 | 18.4 | 25.1 | A | B |
| | 13 | 3 | 39.3 | 18.4 | 20.9 | A | B |
| | 14 | 4 | 39.3 | 18.4 | 20.9 | A | B |
| | 15 | 5 | 39.3 | 18.4 | 20.9 | A | B |
| | 16 | 6 | 37.3 | 18.4 | 18.9 | B | B |
| | 17 | 7 | 34.9 | 18.4 | 16.5 | B | B |
| | 18 | 8 | 39.0 | 18.4 | 20.6 | A | B |
| | 19 | 9 | 39.0 | 18.4 | 20.6 | A | B |
| Comp. | 13 | 10 | 45.7 | 18.4 | 27.3 | A | C |
| Ex. | 14 | 11 | 36.3 | 18.4 | 17.9 | A | C |

As shown in Table 3, in Comparative Examples 1 and 2 using resin particle-free inks 10 and 11, respectively, at least one of the optical density and the water resistance was evaluated as C, that is, an unacceptable level. Comparison of the evaluation results of "peeling-off of image" shown in Tables 3 and 4 has revealed that the peeling-off of image is suppressed by satisfying the relationship $\gamma_I > \gamma_R$ when the heating roller is brought into contact with the ink. These results suggest that in order to achieve results satisfactory in both optical density and water resistance of the image and suppression in peeling-off of an image, it is necessary to use a resin particle-containing ink and at the same time, satisfy the relationship $\gamma_I > \gamma_R$ when the heating roller is brought into contact with the ink. Comparison of the evaluation results of "peeling-off of image" and "optical density" shown in Tables 3 and 5 suggest that even if the total ink application amount per unit area is equal (about 10.0 ng), images obtained are sometimes different in optical density, though the "peeling-off of image" is on the same level. According to the microscopic observation of the images different in optical density, the image having a low optical density had a portion not colored because ink dots did not spread sufficiently.

(Evaluation 4)

Various conditions in Evaluation 4 were set as described below. The heating roller was adjusted so as to be brought into contact with the ink present on the surface of the recording medium after a predetermined time had passed after application of the ink to a predetermined position of the recording medium. Conditions except them were set similar to those in the above-described "Evaluation 1".

[Suppression of Wrinkling]

A solid image was recorded by applying Ink 3 to the whole surface of an A4 recording medium by changing the period of time from ink application to heating as shown in Table 6 and using all the ejection orifices of a line head used for recording of an image. The recording medium used was plain paper ("PB Paper", trade name; product of Canon). The degree of wrinkling just after recording was visually checked and suppression of wrinkling was evaluated based on the following evaluation criteria. The evaluation results are shown in Table 6.

AA: The recorded matter did not wrinkle.

A: Although the recorded matter wrinkled slightly, it was not so severe as to cause floating of the recording medium at the four corners thereof.

B: The recorded matter wrinkled and the recording medium floated slightly at the four corners thereof.

C: The recorded matter wrinkled and the whole recording medium waved.

TABLE 6

Conditions and results of Evaluation 4

| | | Evaluation conditions | | | | |
|---|---|---|---|---|---|---|
| | | The period of time from ink application to heating (msec) | Dynamic surface tension of ink when heated $\gamma_I$ (mN/m) | Surface tension of roller $\gamma_R$ (mN/m) | $\gamma_I - \gamma_R$ (mN/m) | Evaluation results Suppression of wrinkling |
| Example | 20 | 100 | 42.5 | 18.4 | 24.1 | AA |
| | 21 | 200 | 39.3 | 18.4 | 20.9 | AA |
| | 22 | 300 | 37.9 | 18.4 | 19.5 | AA |
| | 23 | 400 | 36.9 | 18.4 | 18.5 | A |
| | 24 | 500 | 36.2 | 18.4 | 17.8 | A |
| | 25 | 600 | 35.6 | 18.4 | 17.2 | A |
| | 26 | 700 | 35.2 | 18.4 | 16.8 | A |
| | 27 | 800 | 34.9 | 18.4 | 16.5 | A |
| | 28 | 900 | 34.7 | 18.4 | 16.3 | A |
| | 29 | 1000 | 34.5 | 18.4 | 16.1 | A |
| | 30 | 1100 | 33.8 | 18.4 | 15.4 | B |

Inks 1 and 2 and 4 to 9 were also evaluated for "suppression of wrinkling". The results have revealed that similar to Ink 3, wrinkling is suppressed with a decrease in the period of time from ink application to heating.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-073750, filed on Apr. 6, 2018, and Japanese Patent Application No. 2019-056658, filed on Mar. 25, 2019, which are hereby incorporated by reference herein in their entirety.

What is claimed is:

1. An ink jet recording method, comprising:

an ink application step comprising a step of ejecting an aqueous ink comprising a resin particle from a line head to apply the aqueous ink to a predetermined position of a recording medium having ink absorbability; and a fixing step comprising a step of bringing a heating roller into contact with the aqueous ink applied to the recording medium to heat the aqueous ink and to fix the aqueous ink to the predetermined position, wherein a dynamic surface tension $\gamma_1$ (mN/m) of the aqueous ink when the heating roller is brought into contact therewith is higher than a surface tension $\gamma_R$ (mN/m) of the heating roller.

2. The ink jet recording method according to claim 1, wherein the dynamic surface tension $\gamma_1$ (mN/m) of the aqueous ink is higher than the surface tension $\gamma_R$ (mN/m) of the heating roller by 15.0 mN/m or more.

3. The ink jet recording method according to claim 1, wherein a period of time from application of the aqueous ink to the recording medium to the contact of the heating roller to the aqueous ink is 1,000 msec or less.

4. The ink jet recording method according to claim 1, wherein a period of time from application of the aqueous ink to the recording medium to the contact of the heating roller to the aqueous ink is 300 msec or less.

5. The ink jet recording method according to claim 1, wherein a material constituting a surface of the heating roller is a fluorine-based resin or polyimide.

6. The ink jet recording method according to claim 1, wherein in the ink application step, when based on image data having a coverage, with the aqueous ink, of 100%, the aqueous ink is applied to a unit region of the recording medium comprised of a plurality of combinations of unit pixels determined by a resolution, an ink droplet of the aqueous ink is applied to each of the unit pixels constituting the unit region.

7. The ink jet recording method according to claim 1, wherein the aqueous ink contains comprises a self-dispersible pigment.

8. The ink jet recording method according to claim 1, wherein the resin particle has a minimum film forming temperature of 60° C. or less.

9. The ink jet recording method according to claim 1, wherein the dynamic surface tension γI (mN/m) of the aqueous ink is 25.0 mN/m or more to 65.0 mN/m or less.

10. The ink jet recording method according to claim 1, wherein the dynamic surface tension γI (mN/m) of the aqueous ink is 30.0 mN/m or more to 55.0 mN/m or less.

11. The ink jet recording method according to claim 1, wherein the surface tension γR (mN/m) of the heating roller is 15.0 mN/m or more to 60.0 mN/m or less.

12. The ink jet recording method according to claim 1, wherein the surface tension γR (mN/m) of the heating roller is 20.0 mN/m or more to 50.0 mN/m or less.

13. The ink jet recording method according to claim 1, wherein the dynamic surface tension γI (mN/m) of the aqueous ink is higher than the surface tension γR (mN/m) of the heating roller by 50.0 mN/m or less.

14. The ink jet recording method according to claim 1, wherein a period of time from application of the aqueous ink to the recording medium to the contact of the heating roller to the aqueous ink is 100 msec or more.

15. The ink jet recording method according to claim 1, wherein the resin particle has a minimum film forming temperature of 0° C. or more.

* * * * *